US007187534B2

(12) United States Patent
Mishra et al.

(10) Patent No.: US 7,187,534 B2
(45) **Date of Patent: *Mar. 6, 2007**

(54) UNIFORM CHARGE DEVICE WITH REDUCED EDGE EFFECTS

(75) Inventors: Satchidanand Mishra, Webster, NY (US); Edward A. Domm, Hilton, NY (US); Dennis J. Prosser, Walworth, NY (US); Steven P. Nonkes, Monrovia, MD (US); Zoran D. Popovic, Mississauga (CA); Surendar Jevadev, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 274 days.

This patent is subject to a terminal disclaimer.

(21) Appl. No.: 10/721,847

(22) Filed: Nov. 25, 2003

(65) Prior Publication Data

US 2004/0105210 A1 Jun. 3, 2004

Related U.S. Application Data

(63) Continuation-in-part of application No. 10/652,107, filed on Aug. 29, 2003, now Pat. No. 6,909,867.

(60) Provisional application No. 60/407,215, filed on Aug. 29, 2002.

(51) Int. Cl.
*H05F 3/00* (2006.01)

(52) U.S. Cl. ..... 361/220

(58) Field of Classification Search ..... 361/220
See application file for complete search history.

(56) References Cited

U.S. PATENT DOCUMENTS

| | | | | |
|---|---|---|---|---|
| 1,959,154 A | | 5/1934 | Bremer | |
| 2,777,957 A | | 1/1957 | Walkup | |
| 2,890,388 A | * | 6/1959 | Croskey et al. | 361/228 |
| 2,965,754 A | | 12/1960 | Bickmore et al. | |
| 3,888,578 A | | 6/1975 | Etao | |
| 3,937,960 A | | 2/1976 | Matsumoto et al. | |
| 4,112,299 A | | 9/1978 | Davis | |
| 4,344,104 A | | 8/1982 | Habets et al. | |
| 4,456,365 A | | 6/1984 | Yuasa | |
| 4,638,397 A | | 1/1987 | Foley | |
| 5,025,155 A | | 6/1991 | Hattori | |
| 5,300,986 A | * | 4/1994 | Mishra et al. | 399/171 |
| 5,324,942 A | | 6/1994 | Mishra et al. | |
| 6,185,397 B1 | | 2/2001 | Kumar et al. | |
| 6,208,499 B1 | * | 3/2001 | Yonekawa et al. | 361/220 |
| 6,899,854 B2 | * | 5/2005 | Darty | 422/186.04 |
| 6,909,867 B2 | * | 6/2005 | Mishra et al. | 399/173 |

FOREIGN PATENT DOCUMENTS

| | | |
|---|---|---|
| EP | 0 274 894 | 7/1988 |
| EP | 0 917 012 | 5/1999 |

OTHER PUBLICATIONS

Xerox Disclosure Journal, vol. 10, No. 3: May/Jun. 1985; pp. 139-140.

"The Negative Corona Current Distribution for a Long Pin-to-Plane Geometry," P.J. Walsh, et al, *Photographic Science and Engineering*, vol. 28, No. 3, May/Jun. 1984, pp. 101-108.

* cited by examiner

*Primary Examiner*—Burton S. Mullins
*Assistant Examiner*—Lucy Thomas
(74) *Attorney, Agent, or Firm*—Oliff & Berridge, PLC

(57) ABSTRACT

By varying corona producing element height/projection, a more uniform charge potential is achieved. Elements, such as pins or teeth, are shorter at the edges of an element array and grow longer as one moves toward the center of the array. Such variation in height/projection overcomes shielding from adjacent teeth, as well as other effects, to yield the more uniform charging potential.

19 Claims, 5 Drawing Sheets

UNIFORM CHARGE DEVICE WITH REDUCED EDGE EFFECTS

CROSS REFERENCE TO RELATED APPLICATIONS

This is a Continuation-in-Part application of Provisional Patent Application No. 60/407,215, filed 29 Aug. 2002, and to U.S. patent application Ser. No. 10/652,107, filed 29 Aug. 2003 now U.S. Pat. No. 6,909,867.

FIELD OF THE INVENTION

The invention relates to corona producing apparatus.

BACKGROUND AND SUMMARY

Electroreprographic systems, and xerographic systems in particular, use corona producing devices to produce electric fields to, for example, charge retentive photoresponsive surfaces, such as photoreceptor belt or drum surfaces. Various types of such corona charge generating devices include wires, while others include pins or teeth. In all cases, charge uniformity is desirable, and various solutions have been presented to make the fields produced by corona charge generating devices more uniform. U.S. Pat. Nos. 5,324,942; 2,777,957; 2,965,754; 3,937,960; 4,112,299; 4,456,365; 4,638,397; and 5,025,155 disclose various prior art corona charge producing devices; the disclosures of these patents are incorporated by reference into the disclosure of the instant patent application. Xerox Disclosure Journal (Vol. 10, No. 3; May/June 1985) teaches, at pp. 139–140, an alternate approach; the disclosure of this article is also incorporated by reference into the instant patent application.

FIG. 3 shows a typical prior art saw tooth corona producing array in which all teeth project the same amount toward the photoreceptor. Such a uniform amount of tooth projection yields a non-uniform charging potential profile, as seen in FIG. 4, with teeth toward the center of the array having a decreasing contribution. As illustrated by these FIGS. and by the disclosures of the references mentioned above, current design of saw tooth and pin array based corona producing devices are prone to non-uniform charging patterns. Referring to the pins and teeth of such devices as elements, we see that this variation in charging pattern is due to a fundamental problem that causes the electric field to be highest at the edge elements. This is due in part to shielding effects evinced by adjacent elements, so that as one examines the field produced by elements toward the center of an array, one sees lower values since the field from other elements is blocked by the presence of intervening elements. The corona supply therefore is highest near the edge of the charging device. If the print area near the edges is not carefully selected, a dark edge may result in the print.

This effect can be understood from the symmetry and shielding of electric field by neighboring elements. The elements that lie inside the array have symmetrical flow of corona current on both sides, but the elements that lie near the edges have corona current only on one side of the pins. The electric field at the heads of inside elements, therefore, is reduced. As the voltage applied to the array is raised, the outside elements begin to glow first because the threshold field for air breakdown is reached there first. With further rise of voltage, other elements also glow, but the respective current is lower. This can be seen in the lower intensity of glow at these elements. The voltage profile deposited by a corotron or scorotron with such a uniform element projection profile has peaks under the outside edges.

To overcome such non-uniform voltage profiles, embodiments provide a charging apparatus that applies a substantially uniform charge to a charge retentive surface. The apparatus comprises a corona producing device, spaced from the charge retentive surface, that emits corona ions, but with corona producing elements of varying heights. The height of the elements near the edges is reduced so that the distance between the surface to be charged and the ends of the edge elements is greater than that between the surface to be charged and the ends of the inner elements. The actual height is found, for example, by iterative calculation as will be shown below.

DESCRIPTION

Figure 1:
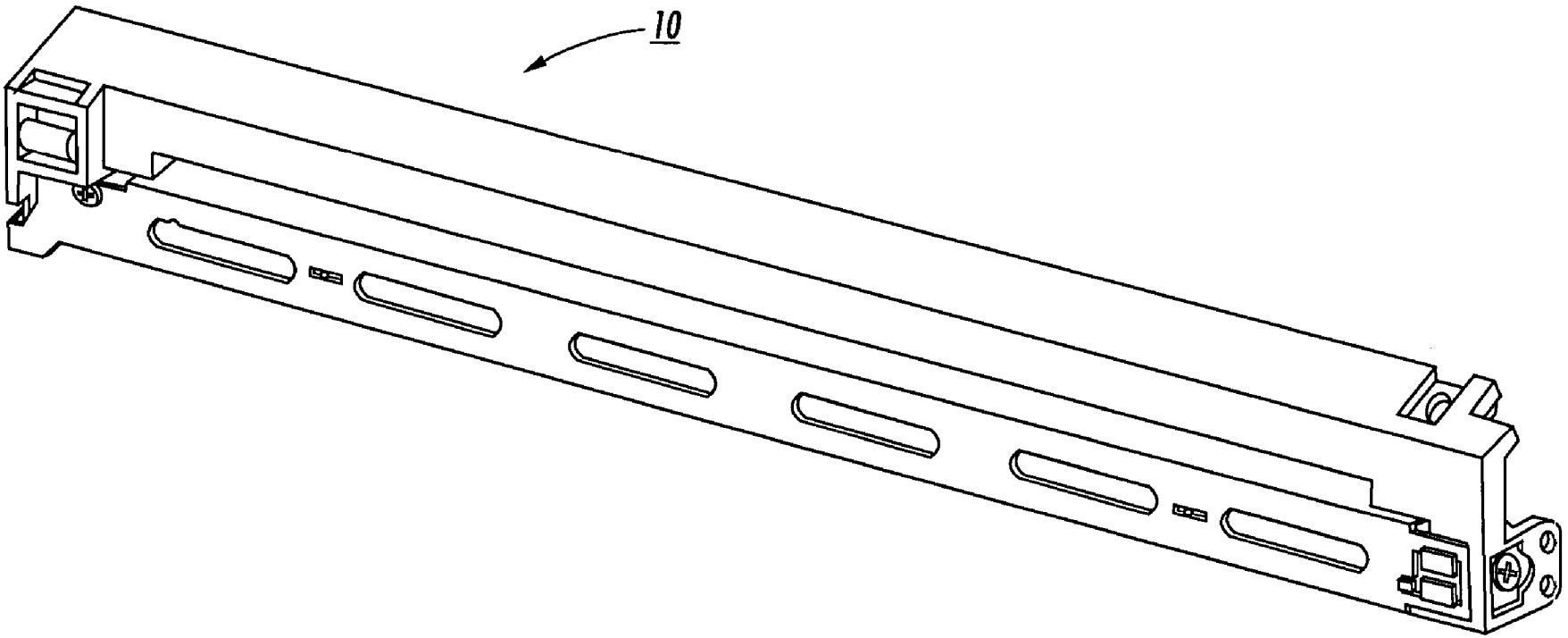
FIG. 1 is an exemplary schematic elevational view of an exterior of a charge device according to embodiments.
Figure 2:
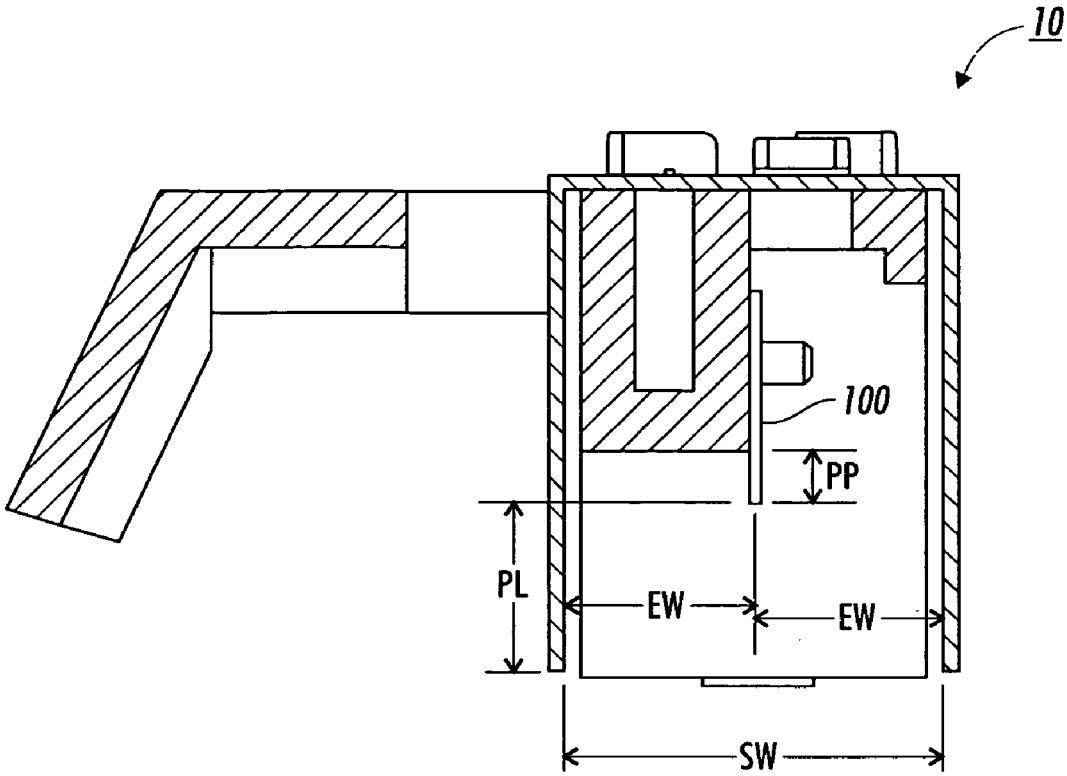
FIG. 2 is a schematic cross-section of the device shown in FIG. 1.
Figure 3:
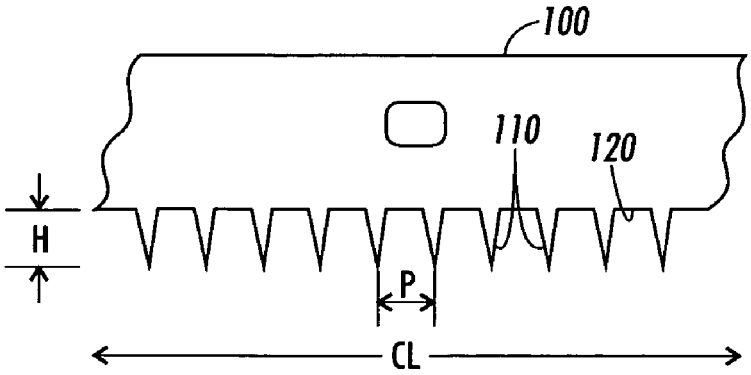
FIG. 3 (PRIOR ART)
FIG. 3 is a schematic plan view of a prior art charge device plate with uniform charge producing elements in the form of saw teeth.
Figure 4:
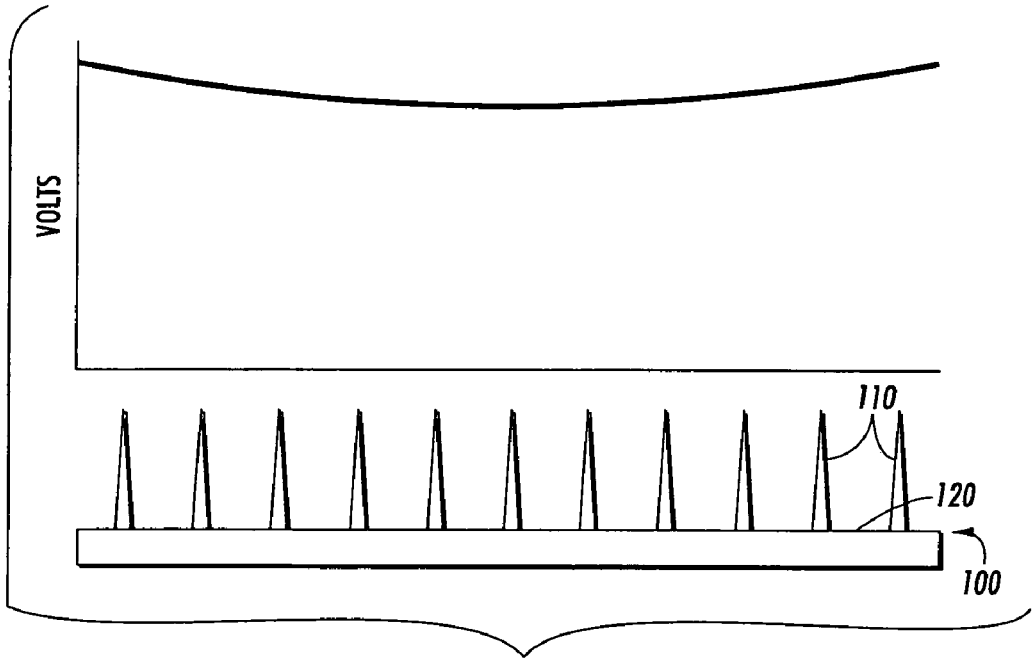
FIG. 4 (PRIOR ART)
FIG. 4 is a schematic view of the prior art charge device plate and showing the fluctuation of voltage along the plate.

For a general understanding of the present invention, reference is made to the drawings. In the drawings, like reference numerals have been used throughout to designate identical elements. FIG. 1 shows a schematic elevational view of a charge device 10 including features of embodiments. Such a device is used in marking machines, such as a printer or photocopier (not shown), to charge a photoresponsive belt (not shown). The charge device can be, for example, a scorotron. From the outside, embodiments appear similar to the prior art. Referring particularly now to FIGS. 2–4, the housing supports a charge producing array 100 that is connected to a power source. In prior art devices, the plate 100 included charge producing elements 110 with uniform height H and equal gaps 120 therebetween yielding a uniform pitch P, as illustrated in FIG. 3. However, as described above because of such factors as shielding by adjacent and outer elements, grid distance to elements, alignment, and material characteristics of individual elements 110, a uniform charging potential may not be realized on the photoreceptor, as schematically shown in FIG. 4. The present invention is an apparatus that improves on prior art solutions, such as altering the relative spacing between a flexible scorotron grid and a charge retentive surface, such as a photoreceptor, to achieve a more uniform charge density and charge potential profile across the usable portion of the surface. More specifically, the corona producing elements in a corona producing/charge producing array, be they pins, teeth, or the like, have varying heights to achieve a more uniform charge density and potential profile. Elements toward a center of the array are taller than elements toward edges of the array to overcome shielding and other effects.

Embodiments include at least one array 100 of elements 110, comprising at least one plurality of corona producing elements 110 directed at and spaced from a charge retentive surface, such as a photoreceptor belt. The elements 110 are arranged in a profile that reduces shielding effects, and are connected to a power source. The array is supported in a housing that can be mounted in an electrophotographic marking device, such as a xerographic multifunction device.

Figure 5:
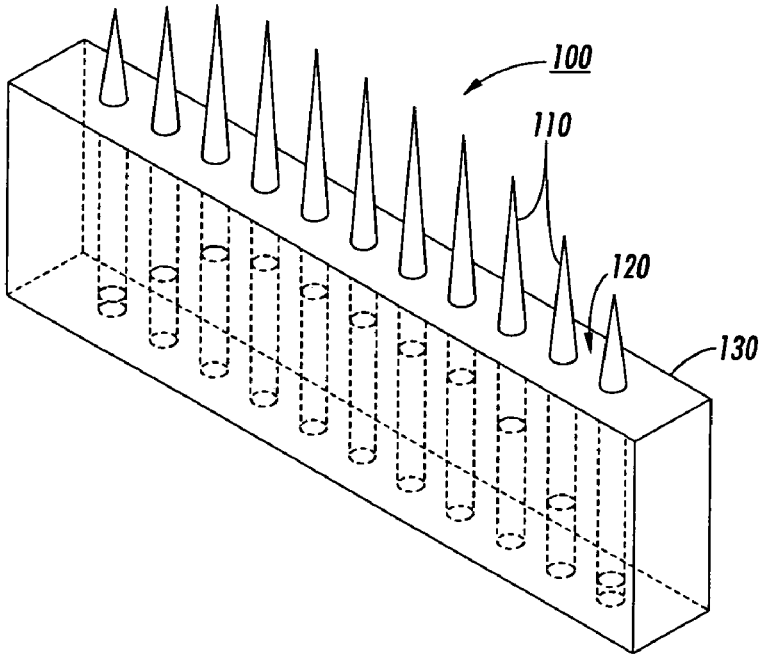
FIG. 5 is a schematic view of an exemplary charge device array using charge producing elements in the form of pins.
Figure 6:
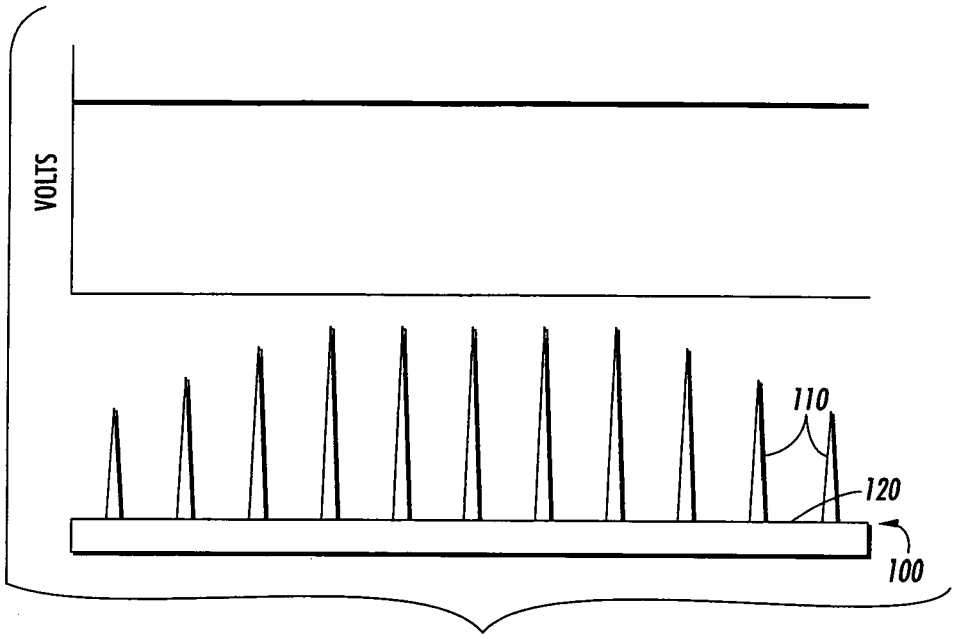
FIG. 6 is a schematic illustration of the charge distribution achieved by embodiments.

As seen in FIG. 5, the at least one plurality of corona producing elements 110 can include an array of pins projecting toward the charge retentive surface, with pins at edges of the array projecting less than pins toward a center of the array. The array of pins can be arranged in a line with pins projecting further toward the charge retentive surface in accordance with their proximity to a center of the line of pins. The pins can be held in a support 130, such as a block that can include bores into which the pins are inserted and in which the pins are held. The depth of pin insertion can be varied to adjust the degree to which the pins project toward the charge retentive surface, or pins of different lengths can be inserted to the same depth. Additionally, the array of pins further can include at least one additional line of pins substantially parallel to the first line of pins and whose pins project further toward the charge retentive surface in accordance with their proximity to edges of the additional line(s) of pins. To accommodate additional effects on the corona and charge profile, the degree of projection of the pins in the lines of pins can vary with the line of pins in which the pins are located. When the proper profile is applied to the elements 110, the charging potential is much more uniform, as illustrated schematically in FIGS. 6 and 7.

Figure 7:
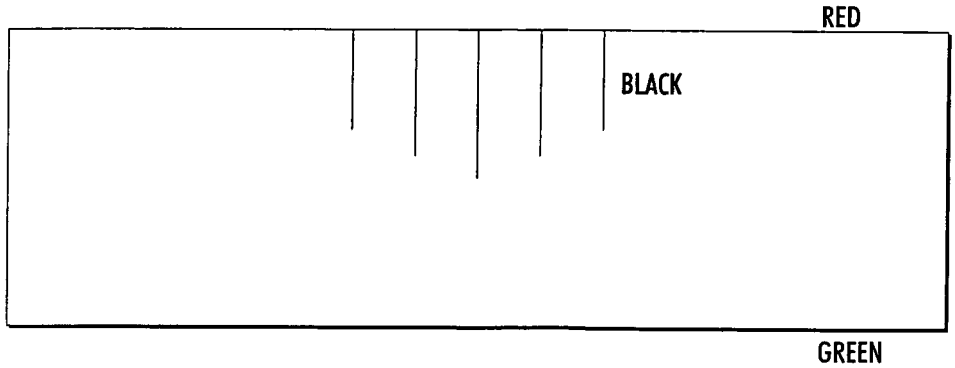
FIG. 7 is another schematic illustration of charge distribution achieved by embodiments.
Figure 8:
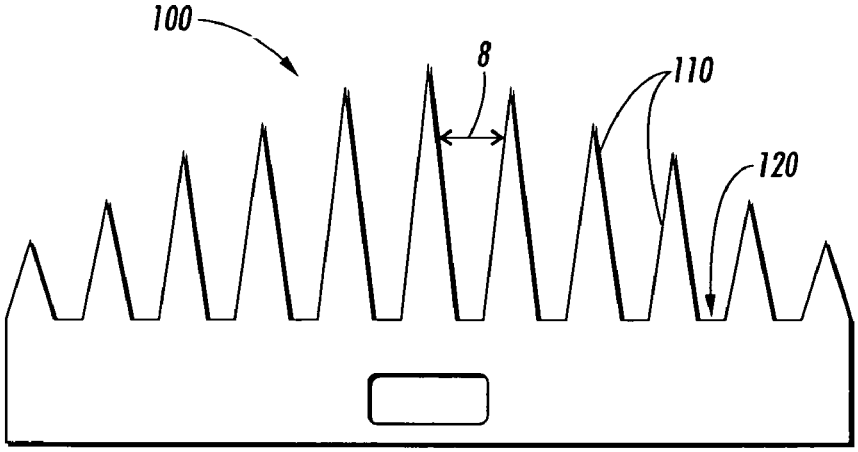
FIG. 8 is a schematic view of an exemplary charge device array using charge producing elements in the form of saw teeth.
Figure 9:
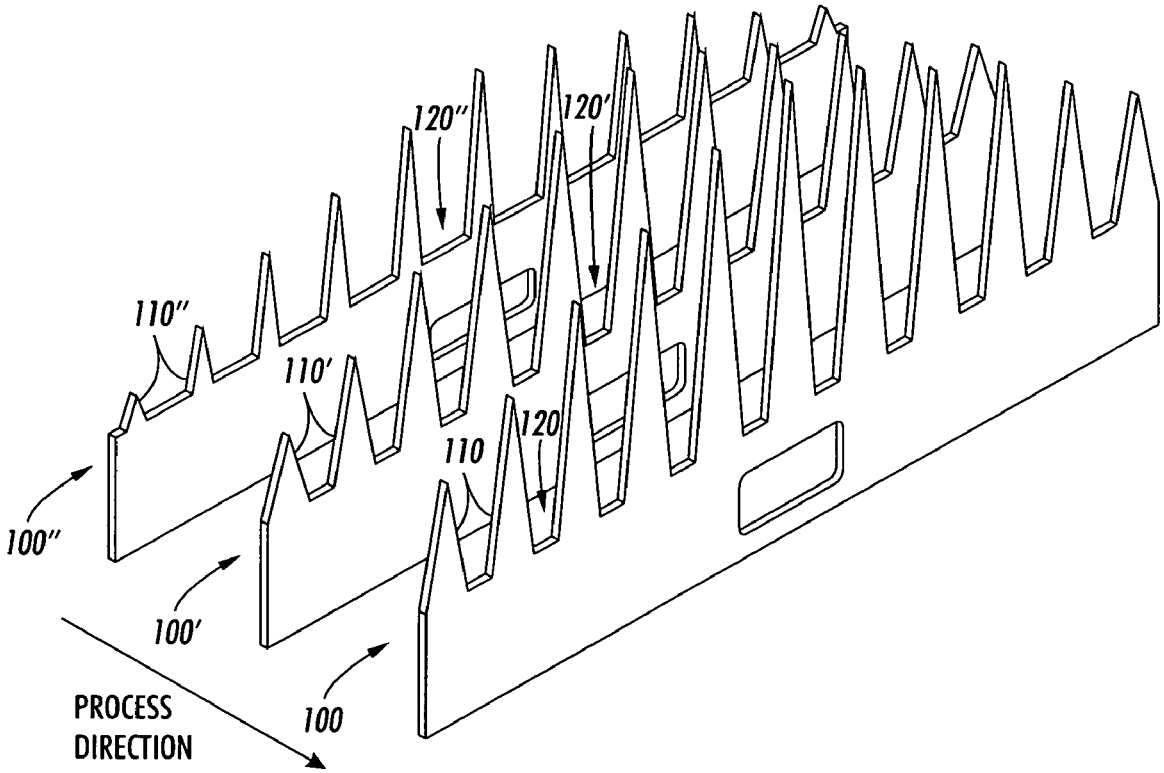
FIG. 9 is a schematic illustration of a plurality of charge device arrays arranged along the process direction according to embodiments.

As an example of an alternative to pins for the corona producing elements, the at least one plurality of corona producing elements can comprise an array of teeth projecting toward the charge retentive surface, as seen in FIG. 8, with teeth at edges of the array project less than teeth toward a center of the array. Such an array of teeth can comprise a line of teeth with teeth projecting further toward the charge retentive surface in accordance with their proximity to a center of the line of teeth, and the teeth can include teeth of a sawtooth configuration. Arrays of teeth can be, for example, stamped from sheet of metal. As with the pin array, the charging potential exhibited by the saw tooth array can be much more uniform, as illustrated schematically in FIGS. 6 and 7, when an appropriate tooth projection/height profile is used.

The corona charge generation is dependent on the electric field in the space between the charging device and the charge retentive surface. This is done in two steps. First one determines the electrical potential in space and then determining the spatial variation of the field. Determining the potential at points throughout the region between a charge-producing array in, for example, a corotron, and the photoreceptor of a marking machine involves solving the Laplace equation $$\nabla^2 V(x, y) = \left(\frac{\partial}{\partial x^2} + \frac{\partial}{\partial y^2}\right) V(x, y) = 0$$

with this region, subject to appropriate boundary conditions. The boundary conditions in the calculations performed are as follows: 1) the corotron was assumed to be at one potential; 2) the charge retentive, top surface was assumed to be at another potential; and 3) the ends of the region were set up to display a reflection of the potential of the region. Given these boundary values, Laplace's equation was numerically solved within this domain by a number of methods, using the Finite Difference Method. In this method, the domain in which the solution is desired is divided into a lattice of cells. We refer to the corners of the cells as mesh points. Laplace's equation was approximated by a discrete version, which is valid at the mesh points. Let the (i,j) index a particular mesh point in this two dimensional domain. Then, $$\frac{\partial^2 V}{\partial x^2} \approx \frac{V_{i+1,j} + V_{i-1,j} - 2V_{i,j}}{h^2}$$

and $$\frac{\partial^2 V}{\partial y^2} \approx \frac{V_{i,j+1} + V_{i,j-1} - 2V_{i,j}}{h^2}$$

where h is the distance between mesh points. Thus, for each pair of indices (i,j) (that is for each mesh point), we have $$V_{i+1j}+V_{i-1j}-4V_{i,j}+V_{i,j+1}+V_{i,j-1}=0.$$

If i=1, 2, . . . N, and j=1, 2, . . . M, then there are NM mesh points. If a mesh point (i,j) lies on the boundary, we use the boundary condition to fix Vij for that mesh point. Thus, the only unknowns in the above equations correspond to the "interior" mesh points. The above equation is just a set of linear equations and we used the Successive Over Relaxation method to solve the equations to get the values of Vij for all interior mesh points. (Other standard methods such as the Jacobi and the Gauss-Seidel methods can also be used.) Once the potential is known, the electric field was obtained by calculating the first derivative. The Finite Difference Method is only one method of solving this problem. Other methods include the Finite Element Method and the Monte-Carlo based methods.

Once the potential was obtained, the electric field components $E_{x\ i,j}$ and $E_{y\ i,j}$ associated with any mesh point (i,j) was found from the finite difference approximations to the first derivative as follows:

$$E_{xi,j} = \frac{V_{i+1,j} - V_{i,j}}{h}$$

$$E_{yi,j} = \frac{V_{i,j+1} - V_{i,j}}{h}$$

where we have assumed that the index i is associated with the x direction and the index j with the y direction. This, however, is quite arbitrary and is not required. The approximations given above define the components along the direction of the lines joining the adjacent mesh points. The magnitude of the electric field can then be obtained from $$E_{i,j}=\sqrt{E_{xi,j}^2+E_{yi,j}^2}$$

In the calculations performed, the corotron elements were assumed to be at one potential and the surface was assumed to be at another potential. The ends of the region were set up to display a reflection of the potential of the region. In FIG. 7, the red members were given the corotron voltage value, the green member was assigned the surface voltage value, and the black members were reflecting the voltage of the region of calculation.

The program used to perform the calculations was also programmed to provide a rough estimation of the magnitude of the electric field at each point by the method outlined above.

Whatever the type of corona producing elements employed, the profile is determined, for example, by iterative adjustment of the elements of the at least one plurality of corona producing elements so that an electric field at substantially all points is substantially equal. In particular, the profile can be determined by applying the formula:

$$E_{i,j}=\sqrt{E_{xi,j}^2+E_{yi,j}^2}$$

where (x,y) represent matrix coordinates of a point of interest, i and j represent iterations, and $E_{i,j}$ is an electric field at the point (x,y) of interest, to achieve a substantially uniform value of E for all points (x,y) between the at least one corona producing element and the charge retentive surface.

Thus, to substantially uniformly charge a charge retentive surface, one can attach at least one plurality of corona charging elements to a power source and determine a respective electric field distribution over each plurality of the at least one plurality of corona charging elements using, for example, the formula above. If the respective electric field is substantially non-uniform, then one adjusts the degree of projection of the elements of the respective at least one plurality of corona charging elements. These actions would be repeated until each respective electric field, and the overall field, is substantially uniform.

While this invention has been described in conjunction with preferred embodiments thereof, many alternatives, modifications, and variations may arise that are not currently foreseeable to those skilled in the art. Accordingly, it is intended to embrace all such alternatives, modifications and variations that fall within the spirit and broad scope of the appended claims.

What is claimed is:

1. A corona producing device comprising:

a plurality of corona producing elements arranged in an array;

the elements being directed at and spaced from a charge retentive surface;

the elements further being arranged in the array profile that reduces shielding effects;

a power source connected to the at least one plurality of corona producing elements; and supports to which the at least one plurality of corona producing elements are attached; wherein the elements include an array of pins projecting toward the charge retentive surface, pins at edges of the array projecting less than pins toward a center of the array;

the array of pins comprises a first line of pins with pins projecting further toward the charge retentive surface in accordance with their proximity to a center of the first line of pins; and bores into which the pins are inserted and in which the pins are held and the depth of pin insertion can be varied to adjust the degree to which the pins project toward the charge retentive surface.

2. The device of claim 1, wherein the array of pins further comprises at least a second substantially parallel line of pins whose pins project further toward the charge retentive surface in accordance with their proximity to edges of the second substantially parallel line of pins.

3. The device of claim 2 wherein the degree of pin projection also varies with the line of pins in which the pins are located.

4. The device of claim 1 wherein elements comprise an array of teeth projecting toward the charge retentive surface, teeth at edges of the array projecting less than teeth toward a center of the array.

5. The device of claim 4 wherein the array of teeth comprises a first line of teeth with teeth projecting further toward the charge retentive surface in accordance with their proximity to a center of the first line of teeth.

6. The device of claim 5 wherein the first line of teeth includes teeth of a substantial sawtooth configuration.

7. The device of claim 5 wherein the first line of teeth comprises a stamped sheet of metal.

8. The device of claim 1 wherein the profile is determined by iterative adjustment of the elements of the at least one plurality of corona producing elements so that an electric field at substantially all points is substantially equal.

9. A corona producing element profile determination method comprising:

determining an electrical potential in space between a charging device and a surface;

determining a spatial variation of an electric field of the electrical potential;

determining the electrical potential in space comprising determining an electrical potential at a plurality of points throughout a region between a charge-producing array of corona producing elements and a photoreceptor of a marking machine to adjust the array profile of the corona producing elements; wherein the elements include an array of pins projecting toward the charge retentive surface, pins at edges of the array projecting less than pins toward a center of the array;

the array of pins comprises a first line of pins with pins projecting further toward the charge retentive surface in accordance with their proximity to a center of the first line of pins; and bores into which the pins are inserted and in which the pins are held and the depth of pin insertion can be varied to adjust the degree to which the pins project toward the charge retentive surface.

10. The method of claim 9 including solving the Laplace equation $$\nabla^2 V(x, y) = \left(\frac{\partial}{\partial x^2} + \frac{\partial}{\partial y^2}\right)V(x, y) = 0$$

in which V is the potential and boundary conditions comprise that corotron electrode elements are assumed to be at one potential, a charge retentive top surface of the photoreceptor is assumed to be at another potential, and the ends of the region display a reflection of the potential of the region.

11. The method of claim 9 wherein, once the potential is obtained, electric field components $E_{x\,i,j}$ and $E_{y\,i,j}$ associated with any mesh point (i,j) is found with:

$$E_{xi,j} = \frac{V_{i+1,j} - V_{i,j}}{h}$$

$$E_{yi,j} = \frac{V_{i,j+1} - V_{i,j}}{h}$$

where the index i is associated with the x direction and the index j with the y direction, and h is the height of the corona producing element at the mesh point (i,j).

12. The method of claim 9 wherein the profile is determined by iterative adjustment of the elements so that the electric field at substantially all points is substantially equal.

13. The method of claim 9 further comprising applying the formula:

$$E_{i,j}=\sqrt{E_{xi,j}^2+E_{yi,j}^2}$$

where (x,y) represent matrix coordinates of a point of interest, i and j represent iterations, and E, is an electric field at the point (x,y) of interest, to achieve a substantially uniform value of $E_{i,j}$ for all points (x,y) between the at least one corona producing element and the charge retentive surface.

14. A method of substantially uniformly charging a charge retentive surface comprising:

attaching a plurality of array-type corona charging elements to a power source;

determining a respective electric field distribution over the corona charging elements;

if the respective electric field is substantially non-uniform, adjusting a projection of the corona charging elements; and repeating the determining and adjusting until the electric field is substantially uniform attached; wherein the elements include an array of pins projecting toward the charge retentive surface, pins at edges of the array projecting less than pins toward a center of the array;

the array of pins comprises a first line of pins with pins projecting further toward the charge retentive surface in accordance with their proximity to a center of the first line of pins; and bores into which the pins are inserted and in which the pins are held and the depth of pin insertion can be varied to adjust the degree to which the pins project toward the charge retentive surface.

15. The method of claim 14 wherein attaching corona charging elements to a power source includes mounting elements in at least one group on a conductive surface and substantially perpendicular to the conductive surface so as to project toward the charge retentive surface.

16. The method of claim 15 further comprising sizing elements on an edge of a plurality of elements to project less than elements located at a center of the plurality of elements.

17. The method of claim 14 further comprising altering a curvature of a conductive surface so that elements at an edge of a plurality of elements are farther from the charge retentive surface than elements toward a center of the plurality.

18. The method of claim 14 wherein determining the electric field of each plurality of elements includes:

solving the Laplace equation $$\nabla^2 V(x, y) = \left(\frac{\partial}{\partial x^2} + \frac{\partial}{\partial y^2}\right)V(x, y) = 0$$

in which V is the potential and boundary conditions comprise that corotron electrode elements are assumed to be at one potential, a charge retentive top surface of the photoreceptor is assumed to be at another potential, and the ends of the region display a reflection of the potential of the region;

finding electric field components $E_{x\,i,j}$ and $E_{y\,i,j}$ associated with mesh points (i,j) with:

$$E_{xi,j} = \frac{V_{i+1,j} - V_{i,j}}{h}$$

$$E_{yi,j} = \frac{V_{i,j+1} - V_{i,j}}{h}$$

where the index i is associated with the x direction and the index j with the y direction, and h is the height of the corona producing element at mesh point (i,j).

19. The method of claim 14 further comprising applying the formula:

$$E_{i,j}=\sqrt{E_{xi,j}^2+E_{yi,j}^2}$$

where (x,y) represent matrix coordinates of a point of interest, i and j represent iterations, and $E_{i,j}$ is an electric field at the point (x,y) of interest, to achieve a substantially uniform value of E for all points (x,y) between the at least one corona producing element and the charge retentive surface.

* * * * *